United States Patent [19]

Hanlet

[11] 4,356,428

[45] Oct. 26, 1982

[54] LIGHTING SYSTEM

[75] Inventor: Jacques M. Hanlet, Loxahatchee, Fla.

[73] Assignee: Intent Patent, A.G., London, England

[21] Appl. No.: 159,072

[22] Filed: Jun. 20, 1980

Related U.S. Application Data

[63] Continuation-in-part of Ser. No. 121,918, Mar. 5, 1980, Pat. No. 4,341,976.

[51] Int. Cl.[3] ..... H01J 61/42; H01J 17/06

[52] U.S. Cl. ..... 313/485; 313/213; 313/217; 313/305

[58] Field of Search ..... 313/210–213, 313/217, 305, 310, 337, 483–486, 491–492, 182–187, 216; 250/365, 504 R; 315/58

[56] References Cited

U.S. PATENT DOCUMENTS

| | | | |
|---|---|---|---|
| 1,408,053 | 2/1922 | Wensley | 313/337 X |
| 2,267,118 | 12/1941 | Marden | 313/485 X |
| 2,845,567 | 7/1958 | Geiger | 313/212 X |
| 3,334,269 | 8/1967 | L'Heureux | 315/58 |
| 3,476,970 | 11/1969 | Gillies et al. | 313/216 X |

*Primary Examiner*—Marvin L. Nussbaum
*Attorney, Agent, or Firm*—Morton J. Rosenberg

[57] ABSTRACT

An improved lighting system (10) which in the preferred embodiment includes a cathode (12) having an external surface (34) being coated with a cathode outside film (40) for emitting electrons therefrom. A first anode (14) extends internal to the cathode (12) for heating the cathode (12) to thereby emit electrons from the external surface (34). A second anode (16) is positionally located external to the enclosed cathode (12) for accelerating the electrons emitted from the cathode external surface (34). A bulb member (18) encompasses the cathode (12), the first anode (14), and the second anode (16) in a hermetic type seal. The bulb member (18) has a predetermined gas composition contained therein with the gas composition atoms being ionized by the cathode emitted electrons. The gas composition ionized atoms radiate in the ultraviolet bandwidth of the electromagnetic spectrum. The bulb member (18) is coated with a fluorescent material (20) for intercepting the ultraviolet energy responsive to the ionization of the gas composition atoms. The fluorescent material (20) radiates in the visible bandwidth of the electromagnetic spectrum to give a visible light output.

73 Claims, 10 Drawing Figures

FIG. 1
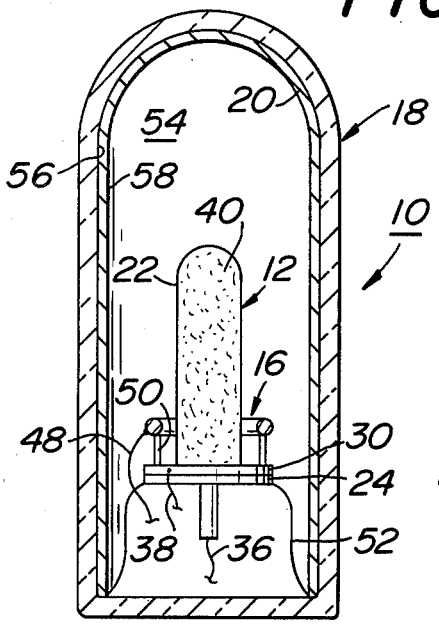
FIG. 2
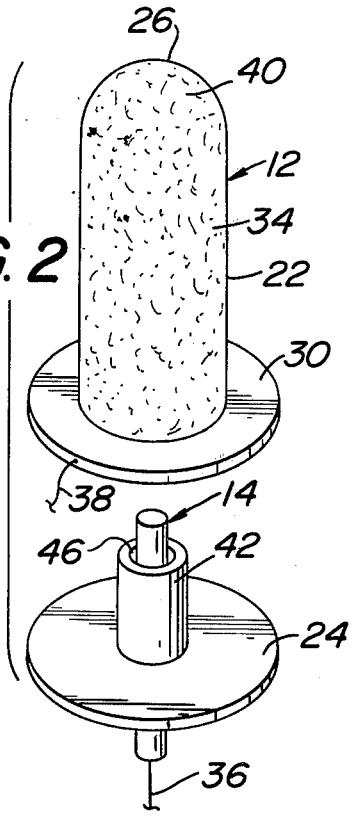
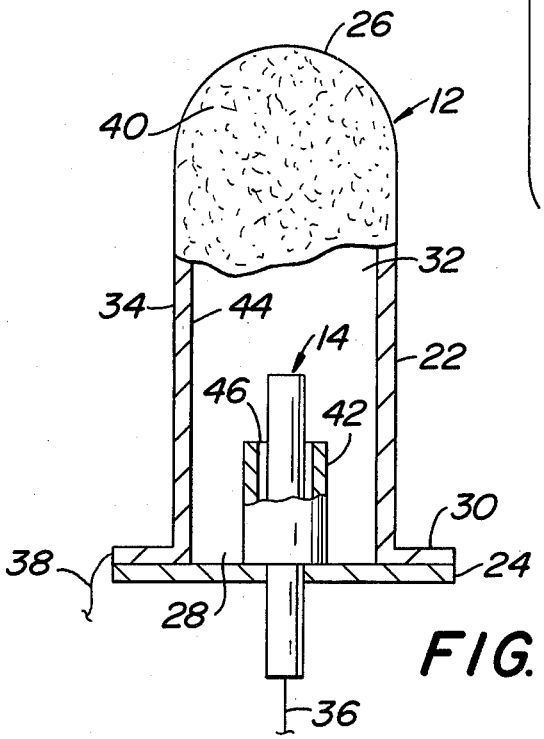
FIG. 3

FIG. 4
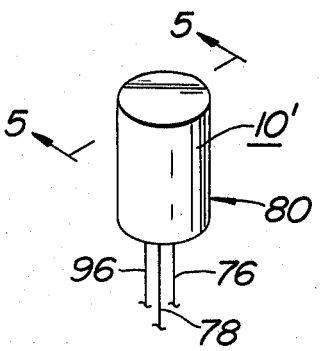
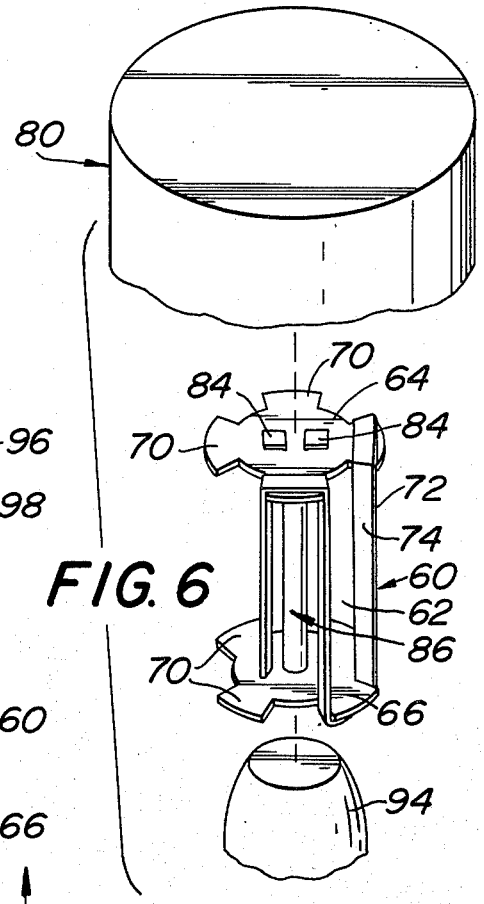
FIG. 6
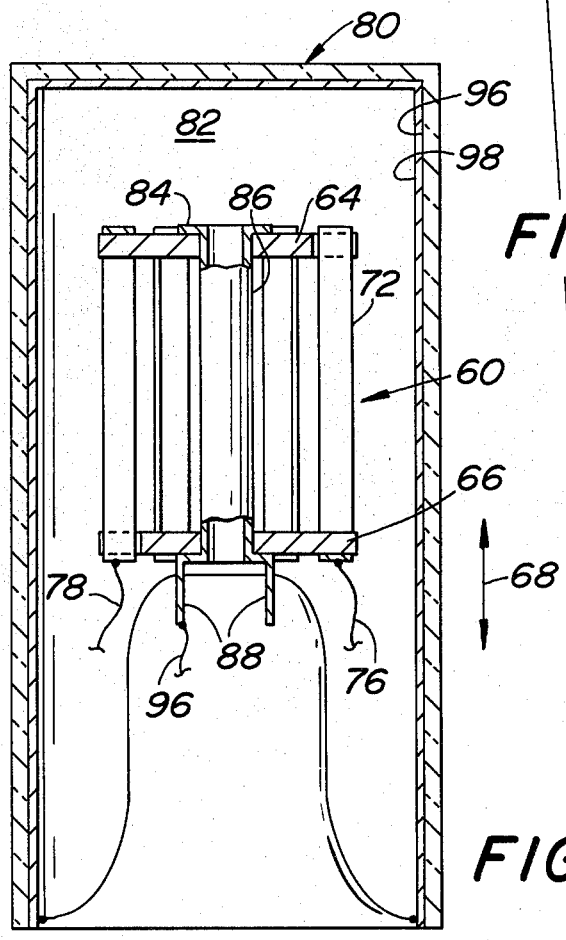
FIG. 5

LIGHTING SYSTEM

REFERENCE TO RELATED APPLICATION

This Patent Application is a Continuation-in-Part of U.S. patent application Ser. No. 121,918, filed on Mar. 5, 1980, entitled: DISPLAY SYSTEM and now U.S. Pat. No. 4,341,976.

BACKGROUND OF THE INVENTION

1. Field of the Invention

This invention relates to lighting systems. In particular, this invention pertains to fluorescent type lighting systems. More in particular, this invention relates to fluorescent type lighting systems which are operable from a standard 110 volt or 117 volt outlet line. Further, this invention pertains to fluorescent type lighting systems which do not necessitate the use of a starter and a choke, or ballast type mechanism within the overall lighting system structure while simultaneously being operable from the standard 110 volt or 117 volt outlet lines. More in particular, this invention relates to a fluorescent type lighting system which has a higher visible light output as a function of energy input than that provided by prior standard fluorescent lighting systems. Further, the instant invention relates to a fluorescent type lighting system wherein a high density of electrons are emitted in order to ionize a gas composition contained within an outer bulb housing for ultraviolet radiation emission to a fluorescent material coated on the inner surface of the light bulb housing.

2. Prior Art

Lighting systems are known in the art. In prior art incandescent filament lighting systems, an electric current is directed through a conducting filament. Molecules of the filament become excited and upon heating up, the filament is caused to glow in the visible bandwidth of the electromagnetic radiation spectrum. The visible energy is radiated external to the structure of the prior art light bulb. However, the prior art type light bulb of this type is extremely inefficient and a vast amount of energy is necessitated to provide light within the visible region of the electromagnetic spectrum. This results in higher costs for use and is an unnecessary usage of energy resources.

Prior art fluorescent tubes or lighting systems which cause a fluorescent material to radiate in the visible region of the electromagnetic spectrum responsive to ionization of gases contained within the fluorescent tubes is known in the art. However, such prior art fluorescent tubes demand a high voltage to be passed between electrodes contained within the fluorescent tubes in order to initiate an internal gas discharge. Thus, such prior art fluorescent tubes require a starter and a ballast type system for producing a pulse of high voltage electrical energy. In order to provide this additional structure, the prior art fluorescent tubes must utilize a substantial volume and are not generally usable in place of incandescent filament type light bulbs. Additionally, such prior art fluorescent tubes require a large amount of additional electrical structure to achieve the required light output. With the additional structure, such prior art fluorescent tubes are not able to be utilized in place of or in substitution of standard incandescent light bulbs.

SUMMARY OF THE INVENTION

A lighting system which includes a cathode for emitting electrons from an external surface thereof. A first anode extends internal to the cathode for heating the cathode thereby emitting electrons from an external surface. A second anode is positionally located external to the cathode for accelerating electrons emitted from the cathode external surface. A bulb member encompasses the cathode, as well as the first and second anodes in a substantially hermetic seal. The bulb member includes a predetermined gas composition contained therein. Gas composition atoms are ionized by the cathode emitted electrons and the gas composition ionized atoms radiate in the ultraviolet bandwidth of the electromagnetic spectrum. The bulb member is further coated with a fluorescent material on an internal surface thereof for intercepting the ultraviolet energy responsive to the ionization of the gas composition atoms.

BRIEF DESCRIPTION OF THE DRAWINGS

FIG. 1 is a sectional elevational view of the preferred embodiment of the lighting system showing the cathode mounted within the overall bulb housing member;

FIG. 2 is a perspective exploded view of the cathode and the first anode;

FIG. 3 is a section elevational cut-away view of the cathode showing the first anode mounted therein;

FIG. 4 is a perspective view of an embodiment of the lighting system;

FIG. 5 is a section elevational view of the embodiment shown in FIG. 4 showing both the embodiment anode and cathode mounted within the external bulb housing member;

FIG. 6 is an exploded view of the embodiment shown in FIG. 4 providing a perspective view of the cathode and anode elements;

DESCRIPTION OF THE PREFERRED EMBODIMENTS

Figure 7:
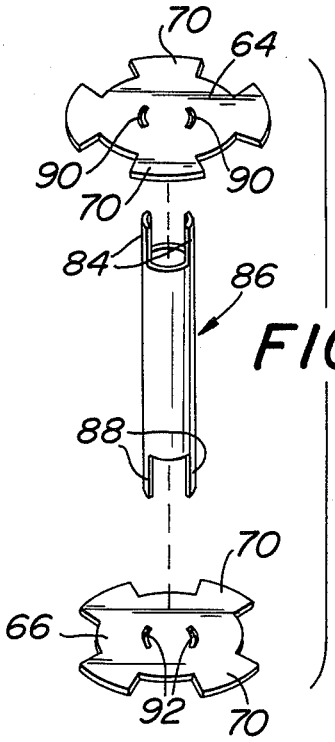
FIG. 7 is a perspective exploded view of the anode structure for the embodiment of FIG. 4.

Referring now to FIGS. 1–3, there is shown the basic structure of the preferred embodiment of lighting system 10. In overall concept, lighting system 10 converts energy within the ultraviolet bandwidth of the electromagnetic spectrum into energy within the visible bandwidth of the electromagnetic spectrum through excitation of fluorescent compositions. Lighting system 10, as is herein described, may be utilized for domestic and commercial environments for use in place of common filament type light bulbs, as well as fluorescent lighting systems.

In prior incandescent filament lighting systems, an electric current is directed through a conducting filament. The various molecules of the filament become excited and the filament heats up. The heating of the filament finally causes a flow in the visible bandwidth of the electromagnetic spectrum which is radiated external to the structure of the incandescent filament lightbulb. This principle of lighting is extremely inefficient when taking into consideration the amount of energy necessitated to provide light within the visible region of the electromagnetic spectrum.

Fluorescent tubes or lighting systems generally include a mixture of a noble gas such as Neon or Argon and a secondary gas such as Mercury. Within the fluorescent tube, there is generally provided a pair of filament type electrodes coated with a material which readily emits electrons when heated. When the electrical current is introduced to the filaments, the filaments heat up and emit electrons wherein one acts as an anode and one acts as a cathode at some particular time interval. In such prior fluorescent tubes, an extremely high voltage between the electrodes is necessitated in order to initiate the noble gas discharge. Thus, there is provided with such fluorescent tube, a starter and a choke or ballast type system. The starter is used for automatically breaking the circuit when the filaments have heated up which then causes the choke generally being an induction coil to produce a pulse of high voltage electricity. This pulse of high voltage electricity initiates the noble gas discharge and subsequently, the Mercury or other metal discharge. Such is self-sustaining with a continuous flow of electrons being formed between the electrodes. The vapor of the Mercury or other gas metal is ionized and radiation is produced in the ultraviolet region of the electromagnetic spectrum. The radiation then impinges a fluorescent material which is coated on the internal surfaces of the tube and such glows by absorbing the invisible ultraviolet and re-radiating it as a visible light. Fluorescent lighting has been found to operate at lower temperatures than incandescent filament light bulbs and additionally, more of the electrical energy goes into the emission of visible light and less into heat than that found in the incandescent filament type light bulbs. Such fluorescent tubes have been found to be relatively efficient and may be up to five times as efficient as filament light bulbs. However, such fluorescent lighting systems do necessitate a high initial input of electrical energy and further necessitate the use of starters and ballasts for initiation of the self-sustaining discharge. This complicates and increases the costs of such systems.

In opposite, the subject lighting system 10 is directed to the production of energy within the ultraviolet bandwidth of the electromagnetic spectrum responsive to the ionization of metal atoms without the necessity of using a choke or ballast system. Additionally, the subject lighting system 10 may be operated over standard domestic or commercial electrical line inputs.

Referring to FIGS. 1–3, lighting system 10 is based upon the concept of initiating electron flow from an external surface of cathode 12. Cathode 12 is heated when a voltage is applied between first anode 14 and cathode 12. This causes a discharge of gas within cathode 12. The gas is ionized and upon intercepting the internal surface of cathode 12 causes the release of electrons. Such release of electrons further ionize the internal gas in a cumulative fashion. The cumulative ionization results in the overall heating of cathode 12. Electrons are driven from the external surface of cathode 12 due to the heating process and are accelerated by second anode 16 mounted external to cathode 12. The electrons passing from cathode 12 impinge and interact with a gas metal vapor contained within bulb 18. The gas atoms are ionized and radiate in the ultraviolet bandwidth of the electromagnetic spectrum. The ultraviolet energy impinges on a coating of fluorescent material 20 coating the inner surface of bulb member 18. The fluorescent material then radiates within the visible bandwidth of the electromagnetic radiation spectrum.

Referring to the basic structural concepts of lighting system 10, such includes cathode 12 utilized for emitting electrons from an external surface thereof. Cathode 12 includes cathode sleeve member 22 and cathode base member 24. Cathode sleeve member 22 is generally cylindrical in contour having opposingly directed closed end 26 and open end 28. Cathode sleeve member 22 may include cathode flange 30 extending around the periphery of cathode open end 28 for purposes to be described in following paragraphs. As has been stated, cathode sleeve member 22 may be cylindrical in contour and additionally, is formed of metals or alloys commonly used in the fabrication of indirectly heated oxide cathodes which are well-known and commercially available. Sleeve member 22 may be formed of Molybdenum, Tantalum, Zirconium, Tungsten, Nickel, or other alloys commonly used in such heated oxide cathode manufacturing. Cathode sleeve member 22 and associated cathode flange 30 may be fabricated in one-piece formation and would preferably be seamless in overall fabrication.

Cathode base member 24 is mounted to cathode flange 30 and hermetically sealed to cathode sleeve member 22. As shown in FIG. 3, the combined structure of base member 24 and cathode sleeve member 22 form cathode internal chamber 32. Hermetic sealing between cathode sleeve 22 and cathode base member 24 may be provided by a number of well-known techniques utilizing adhesive mechanisms such as glass frit sealing, or some like fabrication not important to the inventive concept as is herein described.

Cathode base member 24 may either be formed of a dielectric material such as a ceramic composition, or may be formed of the same or similar metal composition of sleeve member 22. In the event that cathode base member 24 is formed of a metal similar to that of cathode sleeve member 22, then an insulation member must be placed around the surface of first anode 14 and cathode base member 24.

Subsequent to sealing of sleeve member 22 to base member 24, a cathode gas composition is inserted into cathode internal chamber 32 at a predetermined pressure. Inert gases such as Helium, Neon, Argon, Krypton, Xenon, or Hydrogen as well as combinations thereof, have been used successfully. In actual practice, a minimum suitable pressure between 4.0 and 6.0 mm Hg has been found useful where a diameter of 0.5 cm is used on tubular sleeve member 22. Upon application of a potential between first anode 14 and cathode 12, there is a predetermined voltage corresponding to the breakdown which is described in Paschen's Law. This Law states that the breakdown potential between two terminals in a gas is generally proportional to the pressure multiplied by the gap length. It has been found advantageous that the gas composition predetermined pressure within cathode internal chamber 32 be maintained approximately in accordance with the formula:

$$2.0 < p \cdot d < 3.0$$

where:

p = predetermined gas composition pressure in mm Hg d = predetermined diameter of sleeve member in cm.

As is seen in FIG. 3, first anode 14 is mounted to cathode base member 24 and passes internal to chamber 32. As is clearly seen in following paragraphs, heating of cathode 12 provides emission of electrons from cathode external surface 34. In construction, first anode 14 may be an electrical wire or may be an electrode of electrically conducting composition. First anode 14 is electrically coupled to first anode lead wire 36 which is directed to a standard domestic or commercial outlet line. As can be seen, cathode 12 is also coupled to a standard outlet line through cathode lead wire 38. In order to maximize efficiency of the overall system, a resistor may be inserted in series with cathode 12 on lead 38. A resistor having a value of approximately 250 ohms has been successfully used in this manner. When a voltage is applied between first anode 14 and cathode 12, cathode 12 is essentially made negative. A discharge is instantaneously established and depending on the current allowed to flow in the discharge by the magnitude of the source's internal heat impedance, will quickly heat the metal walls of cathode 12. Cathode external surface 34 is coated with oxide film 40. Cathode oxide film 40 may be an oxide of Barium, Strontium, Calcium, or some like metallic oxide coating which emits a high density of electrons upon being heated.

Barrier member 42 is clearly seen in FIGS. 2 and 3 surrounding first anode 14 throughout a substantial length of the extension within internal chamber 32. Barrier element 42 is formed of a dielectric material composition such as glass. As is seen, barrier element 42 is in non-contact relation with first anode 14. Barrier element 42 is mounted on cathode base member 24 in fixed relation thereto to provide a screening effect for metallic atoms which may be displaced from cathode internal surface 44.

When a potential is initiated between first anode 14 and cathode 12, gas is ionized within chamber 32. Impingement on internal surface 44 causes atoms of metal to be displaced from the walls of cathode 12. The metal atoms will deposit on a random basis at any point within cathode 12. If the metallic atoms from internal surface 44 deposit in a manner such that there is an electrical path between first anode 14 and base member 24, or cathode sleeve member 22, then there will be a shorting of these electrodes which are at different potentials. Thus, in order to minimize the probability of defining a short due to metal deposit within the cathode 12, barrier element 42 is inserted around first anode 14 in non-contact relation thereto.

In this case, metal deposit would have to pass internal to barrier element 42 through annular openings 46 and coat the internal surface of barrier element 42 before such reaches base member 24 in order to short the entire system. This has the effect of lengthening the life of lighting system 10 and provides a shorting screen for the entire system. Thus, barrier element 42 being mounted to cathode base member 24 surrounding first anode 14 maintains electrical insulation between first anode 14 and cathode base member 24 for the purposes and objectives as hereinbefore described.

Second anode 16 is positionally located external to cathode 12 and is used for accelerating electrons emitted from external surface 34 and coating 40 when a potential is applied to second anode lead 48. Second anode 16 is actuated through a standard outlet as is the case in cathode lead 38 and first anode lead 36. Second anode 16 may be mounted to flange 30 through dielectric struts 50 or some like technique not important to the inventive concept as is herein described, with the exception that second anode 16 be electrically insulated from cathode 12.

Second anode 16 is shown as an annulus type structure. However, it is to be understood that second anode 16 may be a lead wire or some other type of contour which only has as its criteria, the fact of being displaced from cathode 12. The object of sound anode 16 is to accelerate electrons passing from coating 40. When a voltage is applied to second anode 16 which makes it positive with respect to cathode 12, then a discharge occurs between cathode 12 and second anode 16. Due to the fact that the pressure of gas maintained within bulb member 18 (as will be described in following paragraphs) is less than that within internal chamber 32, the mean free path of the emitted electrons is much larger.

As is the usual case in light bulb systems, cathode 12, second anode 16, and first anode 14 may be mounted on stem member 52 positionally located and maintained in fixed securement to internal surfaces of bulb member 18. Stem member 52 may be formed of a glass or some like composition not important to the inventive concept as is herein described. Stem member 52 is merely used as a mounting base for the elements of lighting system 10.

Bulb member 18 encompasses cathode 12, second anode 16, and first anode 14 as is clearly seen in FIG. 1. A hermetic seal is formed to provide bulb member internal chamber 54 which has a predetermined gas composition such as Mercury vapor contained therein at a predetermined pressure. Bulb member 18 may be formed of a glass composition, as is standard in commercial lighting systems. Additionally, bulb member internal surface 56 is coated with fluorescent material 58 as is shown. Fluorescent material 58 may be a standard Phosphor composition. Minute quantities of metallic compositions are introduced into chamber 54 and as an example, when Mercury is introduced, a pressure approximating $10^{-3}$ mm HG is provided for internal chamber 54. In overall concept, gas composition atoms of Mercury or like metal are ionized and radiate in the ultraviolet bandwidth of the electromagnetic spectrum. Fluorescent material 58 intercepts the ultraviolet energy responsive to the ionization of gas composition atoms and re-radiates in the visible light region.

Thus, when a voltage is applied between second anode 16 and cathode 12, there is a high current density source of electrons passing from coating 40 on external surface 34. The voltage difference between cathode 12 and second anode 16 causes a discharge and since the pressure within enclosure or chamber 54 is substantially less than the chamber 32, the mean free path of the electrons is greater. In such an instance, the entire volume of internal chamber 54 is filled with radiation from electrons traveling a longer distance to produce collisions with atoms of Mercury or like metallic gas filling chamber 54. Collision of the electrons with atoms of gas within chamber 54 causes ultraviolet radiation to be expended and such impinges on fluorescent material 58 for re-radiation within the visible light region.

Referring now to FIGS. 4–7, there is shown lighting system 10' which is an embodiment of lighting system 10, as described in previous paragraphs. The basic theory of operation is substantially the same as has previously been discussed, however, structural changes as will be detailed are inherent to lighting system 10'.

Lighting system 10′ includes cathode 60 which is adapted to produce energy in the ultraviolet bandwidth of the electromagnetic spectrum responsive to the ionization of metal atoms. Cathode 60 includes a plurality of cathode openings 62 as is seen in FIG. 6. Cathode openings 62 are defined by the overall structure of cathode 60 as will be defined in following paragraphs.

Cathode 60 includes a pair of dielectric disk members 64 and 66 which are displaced each from the other in longitudinal direction 68. Each of disk members 64 and 66 include a plurality of lug members 70 formed on a peripheral surface of disk members 64 and 66 with the lug members 70 extending radially therefrom as is seen in FIGS. 6 and 7.

In the construction of cathode 60 of lighting system 10′, metallic ribbon 72 is positionally located in undulating fashion around disk lug members 70 for defining a longitudinally directed sidewall internal surface 74 facing an adjacent sidewall surface 74. Metallic ribbon 72 may be formed of a number of metal compositions, such as Nickel, Aluminum, Tungsten, Zirconium, or some like metal composition. As can be seen, the undulating metallic ribbon 72 defines cathode openings 62.

Sidewall internal surfaces 74 are coated with a predetermined metallic composition for providing a metallic sidewall work function less than approximately 3.0 electron volts. In general, the metallic sidewall composition may be formed of a mixture composition substantially composed of Calcium Carbonate and Strontium Carbonate. The mixture composition is generally fired in a substantial vacuum in order to form a final mixture composition formed on metallic sidewall internal surfaces 74 and may include a final composition mixture of Calcium Oxide for reducing the overall work function of the metallic sidewalls. It is to be noted that the metallic sidewalls defined by the metallic ribbon 72 may be further formed of Lantanum Hexa-Boride.

Cathode 60 of lighting system 10′ further includes a pair of leads 76 and 78 being electrically coupled external to bulb member 80 and is electrically connected to a standard outlet in the normal fashion of light bulb systems.

Bulb member 80 which encompasses cathode 60 includes internal chamber 82 which contains a predetermined gas composition having a predetermined pressure. The gas composition within internal chamber 82 of bulb member 80 may be a number of different types of gases and combinations thereof generally being classified as inert gas compositions. The gaseous medium contained within internal chamber 82 may be formed from the group consisting of Argon, Neon, Krypton, Xenon, Hydrogen, or Helium.

The pressure within internal chamber 82 of bulb member 80 and the displacement distance between sidewall internal surfaces 74 of adjacent portions of metallic ribbon 72 are provided in a predetermined relation in accordance with the general formula:

$$2.0 < p \cdot d < 3.0$$

where:

p = predetermined gas composition pressure within internal chamber 82 in mm Hg.

d = predetermined sidewall displacement distance between adjacent internal surfaces 74 in cm.

Lighting system 10′ further includes anode 86 formed of an electrically conducting metal such as Aluminum, Nickel, or some like composition. Anode 86 may include upper tabs 84 and lower tabs 88 extending from the substantially cylindrical contour of anode 86 in longitudinal direction 68. Upper tabs 84 are insertable through upper disk apertures 90 shown in FIG. 7 and lower tabs 88 are insertable through lower disk apertures 92 in order to form a substantially rigid structure between anode 86 and the cathode, and cathode dielectric disk members 64 and 66. As can be seen in FIG. 5, lower tabs 88 may be bent around a lower surface of dielectric disk member 64 and the entire structure mounted on stem 94 contained within bulb member 80. Stem 94 may be formed of glass or some like material which is standard in the commercial light bulb industry. Lower tabs 88 include lead 96 which is coupled to a standard outlet as was hereinbefore described for leads 76 and 78 of cathode 60.

Mounting of anode 86 and cathode 60 on stem 94 within bulb member 80 may be accomplished through glass frit type sealing or some like technique not important to the inventive concept as is herein described. Additionally, leads 76 and 78 may be inserted internal to stem member 94 in the usual commercial fashion of the manufacture of incandescent light bulbs.

Thus, anode 86 may include a metallic tube-like member which is fixedly secured to opposing disk members 64 and 66 on opposing longitudinal ends thereof. As can be seen in FIGS. 6 and 7, opposing disk members 64 and 66 are axially aligned each from the other in longitudinal direction 68. Tab or anchor tab members 84 and 88 are thus further insertable through upper disk apertures 90 and lower disk apertures 92 formed through upper disk member 64 and lower disk member 66, respectively. Where anode 86 is formed of a metallic tube member, an internal surface is at least partially coated with an electrically resistive composition. The electrically resistive composition which may be formed of a carbon coating layer is coupled to anode electrical lead 96.

In the alternative, anode 86 may be formed of a dielectric material which may include a glass composition tube member fixedly secured to disk members 64 and 66 on opposing longitudinal ends thereof. In this case, upper tab members 84 and lower tab members 88 would not be present and the overall formation of anode 86 would be in the form of a cylindrical tube or cylinder. In such a case, the dielectric tube member would have an electrically conductive coating layer formed on an external surface thereof for interfacing directly with cathode 60. Where anode 86 is formed of a glass type composition tube member, there would be an internal surface at least partially coated with an electrically resistive coating and such would be electrically coupled to the electrically conductive coating on the external surface of anode 86.

Bulb member 80 thus encompasses cathode 60, and anode 86 in a substantially hermetic seal. The hermetic type seal provided for bulb member 80 would be substantially the same as that standardly used for incandescent light bulb hermetic sealing. Bulb member 80 includes internal surface 96 which is coated with a fluorescent material 98 for intercepting ultraviolet energy responsive to ionization of metal ions resulting from the energization of anode 86 and cathode 60. Fluorescent material 98 may be a phosphor composition commonly used in fluorescent type light bulbs.

The ultraviolet radiation being directed to fluorescent material 98 is generated by a gaseous plasma which originates in the negative glow captured in cathode openings 62 between sidewall internal surfaces 74. The energy produced comes from ionized atoms of metal which are sputtered from cathode surfaces 74 and generally consist of the ionized metal's largest spectral lines which are generally found in the ultraviolet bandwidth of the electromagnetic radiation spectrum.

In summary, lighting system 10' shown in FIGS. 4–7 thus includes cathode 60 which is adapted to produce energy in the ultraviolet bandwidth of the electromagnetic spectrum responsive to the ionization of metal atoms. As has been shown, cathode 60 includes a plurality of cathode openings 62 formed by the undulating metallic ribbon 72. Each of the cathode openings 62 define a pair of metallic sidewalls having sidewall internal surfaces 74 which are displaced each from the other by a predetermined distance. The sidewall internal surfaces 74 have a predetermined composition formed thereon for providing a metallic sidewall work function less than approximately 3.0 electron volts.

In this embodiment of lighting system 10', anode 86 is located internal and in fixed displacement with respect to cathode 60 for actuating ionization of the metal atoms of cathode 60 responsive to electrical actuation of a standard outlet line between 110–117 A.C. volts operating at 60 cycles per second or in the alternative 110–117 D.C. volts.

Bulb member 80 encompasses cathode 60 and anode 86 in a substantially hermetic seal. Bulb member 80 has contained therein a predetermined gas composition at a predetermined pressure. Bulb member 80 includes internal surface 96 being coated with fluorescent material 98 for intercepting ultraviolet energy responsive to ionization of metal ions. As has been described, the gaseous medium within bulb member 80 is ionized by an electrical field applied to anode 86 and cathode 60. Gaseous ions impinging on the metallic sidewall composition of metallic ribbon 72 ionizes the metal atoms and produces the ultraviolet energy which impinges the fluorescent material 98 to re-radiate in the visible bandwidth of the electromagnetic spectrum.

In general, the gaseous medium contained within bulb member 80 is formed of a substantially inert gas composition and may be formed from the group consisting of Argon, Neon, Krypton, Xenon, Hydrogen, Helium, or some combination thereof. The metallic sidewall composition coated on metallic ribbon 72 may be formed of a mixture composition substantially composed of Calcium Carbonate and Strontium Carbonate. In the overall manufacture of the final mixture composition formed on the metallic sidewalls, the mixture composition of Calcium Carbonate and Strontium Carbonate may be fired in a substantial vacuum to form the final mixture composition including Calcium Oxide for reducing the work function of the metallic sidewalls. Additionally, Lantanum Hexa-Boride has been successfully used as a metallic sidewall composition for coating metallic ribbon 72.

Additionally, an ultraviolet transparent protective coating layer composition may be formed on an internal surface of fluorescent material 98 for protecting fluorescent material 98 from ion impingement. A number of commercially available ultraviolet transparent protective coating layers are usable, one of which being Tantalum Pentoxide.

Thus, there has been shown a method of radiating energy in the visible bandwidth of the electromagnetic radiation spectrum which includes the initial step of providing at least one cathode 60 having openings 62 formed therethrough defining at least a pair of metallic sidewalls having internal surfaces 74 displaced each from the other by a predetermined distance. The metallic sidewall internal surfaces 74 are coated with a predetermined composition for reducing the metallic sidewall work function to less than approximately 3.0 electron volts. An anode 86 is established in fixed displacement with respect to cathode 60.

Anode 86 and cathode 60 are hermetically sealed within bulb member 80 having a predetermined gaseous medium contained therein which is maintained at a predetermined pressure. Bulb member 80 has internal surface 96 coated with fluorescent material 98. The method of radiating further includes applying a potential between anode 86 and cathode 60 for (1) ionizing the gaseous medium and (2) ionizing a metal atom from the metallic sidewall with the ionized metal atom radiating in the ultraviolet bandwidth of the electromagnetic spectrum. Finally, the ultraviolet radiation is applied to fluorescent material 98 for re-radiation into the visible bandwidth of the electromagnetic spectrum.

Figure 8:
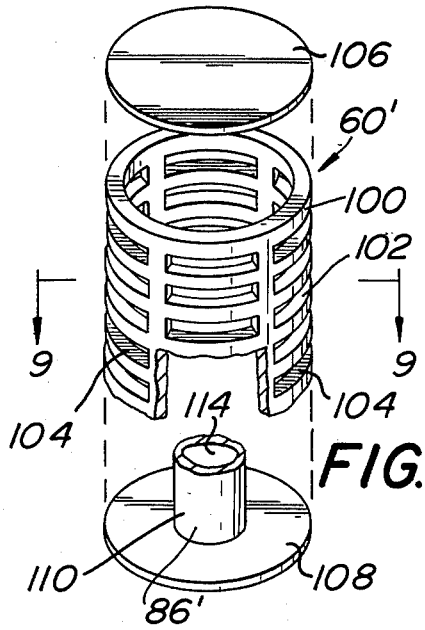
FIG. 8 is a further embodiment shown in perspective exploded view, a slotted cathode structure and an internally directed anode.
Figure 9:
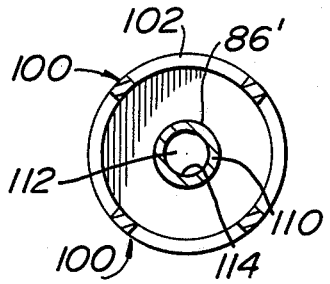
FIG. 9 is a section view of the anode and cathode structure taken along the Section line 9—9 of FIG. 8; and, FIG. 10 is a further embodiment of the anode and cathode structure showing the cathode internal to the anode structure members.

Referring to FIGS. 8 and 9, there is shown a further embodiment of the particular structure of cathode 60 and anode 86 of lighting system 10'. In this embodiment, cathode 60' surrounds anode 86' as is shown. Cathode 60' is formed of a dielectric tubular member extending in longitudinal direction 68 and defines lateral sidewall section 100. Sidewall 100 includes a plurality of slots 102 formed through lateral sidewall 100. As can be seen, slots 102 define slot internal sidewalls 104. Sidewalls 104 are coated with an electrically conductive coating defining metallic sidewalls. As has been the previous case, the metallic sidewall composition may be formed of a mixture composition substantially composed of Calcium Carbonate and Strontium Carbonate. Additionally, the composition as formed may be formed of Lantanum Hexa-Boride or some like composition.

A pair of dielectric disk members 106 and 108 are fixedly secured to opposing longitudinal ends of anode 86' as is shown in FIG. 8. Anode 86' extends in longitudinal direction 68 substantially coincident with an axis line of anode 60'. Anode 86' may be formed of metallic tubular member 110 extending between opposing disks 106 and 108, as is shown. Where anode 86' is formed of a metallic tubular member 110, such includes internal through passage 112 defining anode internal surface 114. Anode internal surface 114 includes an electrically resistive coating layer such as a carbon composition type formation applied to internal surface 114 and being coupled to an anode electrical lead (not shown) exiting from the anode/cathode structure in the identical fashion that was provided for previous embodiments shown in FIGS. 4–7.

Figure 10:
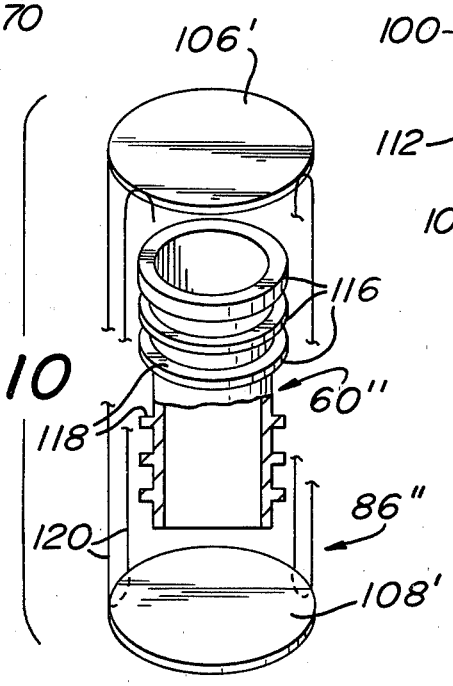

FIG. 10 is directed to still a further embodiment of the overall structure related to lighting system 10'. In this embodiment, cathode 60'' is mounted within and encompassed by anode 86''. In this structural configuration, cathode 60'' is fixedly mounted on opposing longitudinal ends to opposing ceramic disk members 106' and 108'. Fixed securement may be through a glass seal type adhesive bonding, or some like technique not important to the inventive concept as is herein described. Cathode mechanism 60'' may be formed of metallic tubular contoured member, as is shown in cut-away section. Cathode 60'' may be formed of Aluminum, Nickel, or some like metal composition not important to the inventive concept as is herein described. Further, cathode 60'' may include a plurality of annular disk sections 116 displaced each from the other in predetermined relation as defined by previously described equations associated with Paschen's Law. Additionally, annular disk sections 116 define annular section internal walls 118 which are coated with a metallic coating composition as has previously been shown and described in previous paragraphs.

Anode member 86'' is formed of a undulating wire passing in longitudinal direction 68 around the periphery of disk members 106' and 108'. Wire members 120 may be mounted within notches formed in disk members 106' or 108', or in the alternative, may be secured to opposing disk members in any standard manner.

As provided in the embodiments shown in this invention concept, voltage is thus applied to the anode/cathode assembly and a discharge is initiated which is maintained at a potential lower than the striking voltage equal to the standard input voltage 110–117 AC or DC volts at approximately 60 cycles per second. The glow is localized within the through cathode and the ions produced bombard the metallic oxide coating the cathode with dissociates the material at a rate function of the current density. Calcium is ionized and on recombination emits intense ultraviolet radiation which energizes the fluorescent material or phosphor coating of the outer bulb member. Material sputtered from the cathode members remains generally within the cathode cavity. A small quantity of sputtered material may leave the cathode and deposit on the fluorescent material, however, such is transparent in the ultraviolet bandwidth of the electromagnetic spectrum and such a deposit would not generally impair the efficiency of the fluorescent material in converting the ultraviolet energy into the visible light bandwidth.

In all of the embodiments shown in the inventive concept, lighting systems 10 and 10' are adapted to be utilized in the volume space associated with the prior art incandescent light bulbs. Additionally, lighting systems 10 and 10' may easily be adapted for insert into standard outlets, however, the standard screw threaded structure has not been shown in the Figures for purposes of clarity in describing the inventive concept.

The lighting systems as have hereinbefore been described provide the ability to use fluorescent excitation of phosphor material at a relatively low voltage standardly used in domestic utility consumption which does not require the use of inductive ballast. As has been clearly shown, the systems as herein described allow for the production of visible light not relying on the radiation emitted in the positive column to excite phosphor compositions as has been used in prior art systems.

Additionally, the lighting systems as herein described are constructed to be interchangeable with conventional incandescent light bulbs, however, such have an efficiency comparable to prior art fluorescent tubes now commercially available which rely principally on radiation from the negative glow. Further, the lighting systems as herein described may easily be dimmed in intensity without a loss of efficiency, whereas conventional fluorescent lighting known in the prior art is not amenable to a dimming of intensity.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A lighting system comprising:

(a) cathode means for emitting electrons from an external surface thereof, said cathode means including a cathode sleeve member and a cathode base member hermetically sealed each to the other defining a cathode internal chamber, said cathode internal chamber having a cathode gas composition contained therein at a predetermined pressure;

(b) first anode means extending internal said cathode means for heating said cathode means thereby emitting said electrons from said external surface;

(c) second anode means positionally located external said cathode means for accelerating said electrons emitted from said cathode means external surface; and, (d) a bulb member encompassing said cathode means, said first anode means and said second anode means in a substantially hermetic seal, said bulb member having a predetermined gas composition contained therein, said gas composition atoms being ionized by said cathode means emitted electrons, said gas composition ionized atoms radiating in the ultraviolet bandwidth of the electromagnetic spectrum, said bulb member being coated with a fluorescent material for intercepting ultraviolet energy responsive to said ionization of said gas composition atoms, said cathode sleeve member being a substantially cylindrically contoured member having a predetermined diameter, said sleeve member diameter and cathode gas composition pressure being maintained approximately in accordance with the formula:

$$2.0 > p \times d > 3.0$$

where:

p = predetermined gas composition pressure in mm. Hg.

d = predetermined diameter of sleeve member in cm.

2. The lighting system as recited in claim 1 where said first anode means extends through and is fixedly secured to said cathode base member.

3. The lighting system as recited in claim 2 where said cathode base member is formed of a dielectric composition material.

4. The lighting system as recited in claim 2 where said cathode member is formed of an electrically conductive composition material, said first anode means being insulated from said base member.

5. The lighting system as recited in claim 1 where said cathode gas composition is a substantially inert gas composition.

6. The lighting system as recited in claim 5 where said cathode gas composition is formed from the group consisting of Argon, Neon, Krypton, Xenon, Hydrogen or Helium.

7. The lighting system as recited in claim 1 where said cathode sleeve member is formed of a substantially metal composition.

8. The lighting system as recited in claim 7 where said metal composition is formed from the group consisting of Molybdenum, Tantalum, Tungsten, Zirconium or Nickel.

9. The lighting system as recited in claim 1 where said cathode means external surface is coated with a metallic coating composition.

10. The lighting system as recited in claim 9 where said metallic coating composition is a metallic oxide coating formed from the group consisting of Barium, Strontium, Calcium, or Lantanum Hexa-Boride.

11. The lighting system as recited in claim 1 including a barrier element mounted to said cathode base member, said barrier element surrounding said first anode means for maintaining electrical insulation between said first anode means and said cathode base member.

12. The lighting system as recited in claim 11 where said barrier element extends throughout a predetermined extension length of said first anode means internal said cathode means.

13. The lighting system as recited in claim 12 where said barrier element is tubular in contour having an open end portion through which said first anode extends.

14. The lighting system as recited in claim 13 where said barrier element is in non-contact relation with respect to said first anode means.

15. The lighting system as recited in claim 14 where said tubular barrier element is formed of a dielectric composition.

16. The lighting system as recited in claim 1 where said second anode means is positionally located in non-contact relation with respect to said cathode means.

17. The lighting system as recited in claim 16 where said second anode means is an electrically conductive element passing at least partially around said external surface of said cathode means.

18. The lighting system as recited in claim 1 where said bulb member gas composition is a metallic gas composition maintained within said bulb member at a predetermined pressure.

19. The lighting system as recited in claim 18 where said bulb member gas composition is Mercury.

20. The lighting system as recited in claim 1 where said fluorescent material is a phosphor composition.

21. A lighting system comprising:

(a) cathode means adapted to produce energy in the ultraviolet bandwidth of the electromagnetic spectrum responsive to ionization of metal atoms, said cathode means including a plurality of cathode openings, each of said cathode openings defining at least a pair of metallic sidewalls displaced each from the other by a predetermined distance, said metallic sidewalls having a predetermined composition formed thereon for providing a metallic sidewall work function less than approximately 3.0 electron volts;

(b) anode means located in fixed displacement with respect to said cathode means for actuating said ionization of said metal atoms of said cathode means; and, (c) a bulb member encompassing said cathode means and said anode means in a substantially hermetic seal, said bulb member having a predetermined gas composition inserted therein having a predetermined pressure, said bulb member having an internal surface coated with a fluorescent material for intercepting ultraviolet energy responsive to said ionization of said metal ions.

22. The lighting system as recited in claim 21 wherein said metallic sidewall predetermined distance and said gas minimum predetermined pressure are maintained in accordance with the formula:

$$2.0 < p \times d < 3.0$$

where:

p = predetermined gas composition pressure in mm Hg.

d = predetermined sidewall displacement distance in cm.

23. The lighting system as recited in claim 21 where said predetermined gaseous medium within said bulb member is ionized by an electrical field applied to said anode and cathode means, said gaseous ions impinging on said metallic sidewall composition for ionization of said metal atoms for producing said ultraviolet energy.

24. The lighting system as recited in claim 23 where said gaseous medium is formed of a substantially inert gas composition.

25. The lighting system as recited in claim 24 where said gaseous medium is formed from the group consisting of Argon, Neon, Krypton, Xenon, Hydrogen or Helium.

26. The lighting system as recited in claim 25 where said gaseous medium is Helium.

27. The lighting system as recited in claim 21 where said metallic sidewall composition is formed of a mixture composition substantially composed of Calcium Carbonate and Strontium Carbonate.

28. The lighting system as recited in claim 27 where said mixture composition is fired in a substantial vacuum to form a final mixture composition formed on said metallic sidewalls including Calcium Oxide for reducing said work function of said metallic sidewalls.

29. The lighting system as recited in claim 21 where said metallic sidewall composition is formed of substantially Lantanum Hexa-Boride.

30. The lighting system as recited in claim 21 including an ultraviolet transparent protective coating layer composition formed on said fluorescent material layer for protecting said fluorescent material layer from ion impingement.

31. The lighting system as recited in claim 30 where said transparent protective coating layer composition is Tantalum Pentoxide.

32. The lighting system as recited in claim 21 including a stem member secured internal to said bulb member, said cathode and anode means being secured to said stem member, said cathode and anode means including electrical leads passing through said stem member for coupling to an electrical source.

33. The lighting system as recited in claim 21 where cathode means includes:

(a) at least a pair of dielectric disk members displaced each from the other in a longitudinal direction, each of said disk members having a plurality of lug members formed on a peripheral surface thereof and extending radially therefrom; and, (b) a metallic ribbon positioned in undulating manner around said disk lug members for defining longitudinally directed sidewall internal surface facing an adjacent sidewall.

34. The lighting system as recited in claim 33 where said internal surface of each of said sidewalls is coated with said metallic sidewall composition for lowering said metallic ribbon work function to a value less than approximately 3.0 electron volts.

35. The lighting system as recited in claim 34 where said metallic sidewall predetermined distance between adjacent sidewall internal surfaces and said gas minimum predetermined pressure are maintained in accordance with the relation:

$$2.0 < p \times d < 3.0$$

where:

p = predetermined gas composition minimum pressure in mm of Hg, d = predetermined distance between adjacent sidewall internal surfaces of cm.

36. The lighting system as recited in claim 33 where said dielectric disk members are formed of a ceramic material composition.

37. The lighting system as recited in claim 33 where said metallic ribbon is formed of a Nickel composition.

38. The lighting system as recited in claim 33 where said anode means includes a metallic tube member fixedly secured to said disk members on opposing longitudinal ends thereof, said disk members being substantially axially aligned each with respect to the other in said longitudinal direction.

39. The lighting system as recited in claim 38 where said metallic tube member includes at least one anchor tab member extending beyond a tube member longitudinal extension dimension, said tab members being insertable through disk apertures formed through said disk members.

40. The lighting system as recited in claim 39 where said metallic tube member includes an internal surface at least partially coated with an electrically resistive composition, said electrically resistive composition being coupled to at least one anode electrical lead.

41. The lighting system as recited in claim 40 where said electrically resistive composition is formed of a carbon composition.

42. The lighting system as recited in claim 33 where said anode means includes a glass composition tube member fixedly secured to said disk members on opposing longitudinal ends thereof, said glass composition tube member having an electrically conductive coating layer formed on an external surface thereof.

43. The lighting system as recited in claim 42 where said glass composition tube member includes an internal surface at least partially coated with an electrically resistive composition, said electrically resistive coating being coupled to said electrically conductive coating on one end thereof.

44. The lighting system as recited in claim 21 where said cathode means includes a dielectric tubular member extending in a longitudinal direction defining a lateral sidewall, said lateral sidewall having a plurality of slots formed therethrough, said sidewall slots defining slot internal sidewalls.

45. The lighting system as recited in claim 44 where said slot internal sidewalls are coated with an electrically conductive metallic coating defining said metallic sidewalls.

46. The lighting system as recited in claim 45 where said metallic sidewall composition is formed of a mixture composition substantially composed of Calcium Carbonate and Strontium Carbonate.

47. The lighting system as recited in claim 45 where said metallic sidewall composition is formed substantially of Lantanum Hexa-Boride.

48. The lighting system as recited in claim 44 where said metallic sidewall predetermined distance and said gas predetermined pressure are maintained in accordance with the appropriate relation:

$$2.0 < p \times d < 3.0$$

where:

p = predetermined gas composition pressure in mm Hg.

d = predetermined sidewall displacement distance in cm.

49. The lighting system as recited in claim 45 where said anode means extends in said longitudinal direction substantially coincident with an axis line of said dielectric tubular member.

50. The lighting system as recited in claim 49 where said anode means includes an anode metallic tubular member having an internal through passage defining an anode internal surface.

51. The lighting system as recited in claim 50 where said anode means includes an electrical resistor connected in series between said metallic tubular member and an anode electrical lead.

52. The lighting system as recited in claim 51 where said electrical resistor includes an electrically resistive coating layer applied to said anode internal surface, said electrically resistive coating layer being coupled to said anode electrical lead.

53. A method of radiating energy in the visible bandwidth of the electromagnetic radiation spectrum including the steps of:

(a) providing at least one cathode member having openings formed therein defining at least a pair of metallic sidewalls displaced each from the other by a predetermined distance;

(b) coating said metallic sidewalls with a predetermined composition for reducing said metallic sidewall work function to less than approximately 3.0 electron volts;

(c) establishing an anode element in fixed displacement with respect to said cathode member;

(d) hermetically sealing said anode element and cathode member within a bulb member having a predetermined gaseous medium contained therein being maintained at a predetermined pressure, said bulb member having an internal surface coated with a fluorescent material;

(e) applying a potential between said anode and cathode members for (1) ionizing said gaseous medium and (2) ionizing metal atoms from said metallic sidewalls, said ionized metal atoms radiating in the ultraviolet bandwidth of the electromagnetic spectrum;

(f) applying said ultraviolet radiation to said fluorescent material; and, (g) maintaining a relation between said metallic sidewall predetermined distance and said gas predetermined pressure approximately in accordance with:

$$2.0 < p \times d < 3.0$$

where:

p = predetermined gas composition pressure in mm Hg.

d = predetermined sidewall displacement distance in cm.

54. The method of radiating energy as recited in claim 53 where the step of coating said metallic sidewalls includes the step of applying a mixture composition substantially composed of Calcium Carbonate and Strontium Carbonate on said metallic sidewalls.

55. The method of radiating energy as recited in claim 54 where the step of forming is followed by the step of firing said mixture composition in a composition including Calcium Oxide.

56. The method of radiating energy as recited in claim 53 where the step of coating said metallic sidewalls includes the step of applying a mixture composition substantially composed of Lanthanum Hexa-Boride to said metallic sidewalls.

57. The method of radiating energy as recited in claim 53 where the step of hermetically sealing is preceeded by the step of inserting a substantially inert gas composition internal said bulb member.

58. The method of radiating energy as recited in claim 57 where said gaseous medium is formed from the group consisting of Argon, Neon, Krypton, Xenon, Hydrogen or Helium.

59. The method of radiating energy as recited in claim 58 where said gaseous medium is Helium.

60. The method of radiating energy as recited in claim 53 including the step of coating said fluorescent material with an ion impingement protective layer.

61. The method of radiating energy as recited in claim 60 where said protective layer is Tantalum Pentoxide.

62. The method of radiating energy as recited in claim 53 where the step of hermetically sealing includes the step of securing said cathode and anode members to a stem member insertable within said bulb member.

63. The method of radiating energy as recited in claim 62 where the step of securing includes the step of passing electrical leads coupled to said cathode and anode members through said stem member to an external electrical source.

64. The method of radiating energy as recited in claim 53 where the step of providing at least one cathode member includes the steps of:

(a) establishing at least a pair of longitudinally displaced substantially dielectric disk members in alignment each to the other, each of said disk members having a plurality of lug members formed on a peripheral surface thereof, and extending radially therefrom; and, (b) winding a metallic ribbon around said lug members in undulating fashion for defining longitudinally directed sidewall internal surfaces facing an adjacent sidewall surface.

65. The method of radiating energy as recited in claim 64 where said internal sidewall surfaces are coated with said predetermined composition for lowering said metallic ribbon work function to a value less than approximately 3.0 electron volts.

66. The method of radiating energy as recited in claim 64 where the step of establishing said dielectric disk members includes the step of forming said disk members of a ceramic material composition.

67. The method of radiating energy as recited in claim 64 where the step of winding said metallic ribbon includes the step of forming said metallic ribbon of a Nickel composition.

68. The method of radiating energy as recited in claim 53 where the step of establishing an anode element includes the step of fixedly positioning said anode element to said disk members on opposing longitudinal ends thereof.

69. The method of radiating energy as recited in claim 68 where the step of fixedly positioning includes the step of inserting a metallic tube member between said disk members extending in a direction substantially coincident with an axis line of said aligned disk members.

70. The method of radiating energy as recited in claim 53 where the step of providing a cathode member includes the step of establishing a substantially dielectric tubular member extending in a longitudinal direction defining a lateral sidewall, said sidewall having a plurality of slots formed therethrough, said sidewall slots defining slot internal sidewalls.

71. The method of radiating energy as recited in claim 70 where the step of establishing includes the step of coating said slot internal sidewalls with an electrically conductive metallic coating defining said metallic sidewall.

72. The method of radiating energy as recited in claim 71 where said metallic sidewall predetermined composition is substantially composed of a composition mixture of Calcium Carbonate and Strontium Carbonate.

73. The method of radiating energy as recited in claim 71 where said metallic sidewall predetermined composition is substantially composed of Lantanum Hexa-Boride.

* * * * *